US011560787B2

(12) United States Patent
Hunkeler et al.

(10) Patent No.: US 11,560,787 B2
(45) Date of Patent: Jan. 24, 2023

(54) DETERMINING THE LEVEL OF A LIQUID IN A BOREHOLE FOR CONTROLLING OPERATION OF A SUBMERGED PUMP

(71) Applicants: Mariano Andrés Hunkeler, Buenos Aires (AR); Pablo Oscar Severini, Buenos Aires (AR); Leoncio Del Pozo, Chubut (AR); Juan José Malo, Chubut (AR)

(72) Inventors: Mariano Andrés Hunkeler, Buenos Aires (AR); Pablo Oscar Severini, Buenos Aires (AR); Leoncio Del Pozo, Chubut (AR); Juan José Malo, Chubut (AR)

( * ) Notice: Subject to any disclaimer, the term of this patent is extended or adjusted under 35 U.S.C. 154(b) by 0 days.

(21) Appl. No.: 17/372,691

(22) Filed: Jul. 12, 2021

(65) Prior Publication Data

US 2022/0010671 A1 Jan. 13, 2022

(30) Foreign Application Priority Data

Jul. 13, 2020 (AR) ..... 20200101948

(51) Int. Cl.

| | |
|---|---|
| ***E21B 47/047*** | (2012.01) |
| ***E21B 47/18*** | (2012.01) |
| ***E21B 43/12*** | (2006.01) |
| ***E21B 47/095*** | (2012.01) |

(52) U.S. Cl.

CPC ..... *E21B 47/047* (2020.05); *E21B 43/128* (2013.01); *E21B 47/095* (2020.05); *E21B 47/18* (2013.01)

(58) Field of Classification Search

CPC ..... E21B 47/04; E21B 47/047; E21B 47/095; E21B 47/18

See application file for complete search history.

(56) References Cited

U.S. PATENT DOCUMENTS

| | | | | |
|---|---|---|---|---|
| 2014/0124210 | A1* | 5/2014 | Dowell | G01F 23/284 166/336 |
| 2018/0231658 | A1* | 8/2018 | Jalilian | E21B 47/095 |
| 2020/0024940 | A1* | 1/2020 | Judd | G01F 23/2966 |

* cited by examiner

*Primary Examiner* — Kristyn A Hall

(74) *Attorney, Agent, or Firm* — Dickinson Wright PLLC; Andrew D. Dorisio

(57) ABSTRACT

A stand-alone apparatus for determining the level (X) of liquid (F) in oil boreholes (P) overcomes the need of a pressurized gas source. A loudspeaker-type electroacoustical transducer (11) both emits characteristic acoustical signals through the mouth of the borehole and detects the return of an echo from the surface of the liquid downhole for clocking the time-interval between emission and return to determine the level of the liquid. To overcome the limited power inherent in a loudspeaker-type transducer relative to masking borehole acoustic noise, a method of operation correlates the intensity amplitude of the detected echo with the emitted signal. Another solution comprises repeating emission and detection cycles a number of n times and then adding or integrating the n curves into a resulting curve which is filtered. The detected liquid level may be used for determining the submergence and regulating the speed of a pump in the borehole.

22 Claims, 8 Drawing Sheets

DETERMINING THE LEVEL OF A LIQUID IN A BOREHOLE FOR CONTROLLING OPERATION OF A SUBMERGED PUMP

TECHNICAL FIELD

The present invention has application in production fields of oil, gas or water and refers to a detector apparatus and a method for detecting the level of a fluid such as oil in production boreholes.

A string (or tubing) carrying an oil-extractor pump, such as a lineal mechanical pump, a progressive-cavities pump (PCP) or the like, is lowered down such boreholes for pumping oil up through the tubing. Knowledge of the depth at which the fluid lies in the borehole enables, for example, monitoring the submergence of a pump on which the pressure to which it is exposed and the operation efficiency depend. In turn, the submergence of the pump is related to predetermined indices which enable knowing the pressure of the aspired liquid in order to regulate the extraction rate of the downhole pump and maintain operational parameters thereof, such as keep the mechanical energy within safety limits and prevent other inconveniences such as cavitation, thereby lengthening the useful lifespan of the entire installation. The applied criteria is: the column of fluid above the pump being greater than optimum means that that the borehole is under-worked and it would be convenient to increase the pumping rate; on the contrary, the rate should be reduced if the fluid column is too low to prevent risking damage to the pump.

A useful application of the level detector apparatus of the present invention is in determining the level of oil in the borehole in order to monitor the submergence of the pump and optimally control operational parameters thereof.

BACKGROUND

The measurement technique by means of reflecting acoustic waves on the surface of the object to be measured is known as echometry. Currently-used equipment for measuring oil levels in production boreholes have a compressed-inert-gas gun which shoots a powerful pressure pulse into the mouth of the borehole and a detector which receives an acoustic signal reflected by discontinuities and singularities in the surfaces reached by the incident acoustic wave. The gas pulse is tipically around between 0.01 and 0.1 seconds. In addition to the reflection on the downhole air-liquid interphase, the detector receives other reflections from joints and other string-surface irregularities which should be discriminated. The detected reflection signal is then processed to determine the time lapsed between the triggering and reception events for determining the target level. The gun requires connection to a gas pressure source, such as a pressurized gas cylinders. These equipments are costly, require transport of equipment and personnel to the well site and are operated just once for each measurement. This moreover implies using portable equipment, specific for obtaining the fluid level in the borehole and qualified personnel for operating such. The well-site operator needs to employ a specialized squad or outsource the job to a firm specialist in echometries.

Due to the operation being costly, the operators need to limit the number of measurements. Tipically, they have to abide with just a few measurements spaced in time because of this, for example just one monthly level measurement during which the level of crude oil in the borehole may vary significantly. Periodically assessing the fluid level is fundamental for increasing the productivity of the borehole.

One such currently known equipment for determining the level of liquid in a pumped borehole is a level detector marketed by the firm Leutert with the trademark Sonoecho. Its main components are a portable data-acquisition unit with a screen, a nitrogen or $CO_2$ gas gun for emitting a pressure pulse through the borehole mouth, a microphone integrated into the body of the gun for receiving the pressure echos reflected back from the string joints and the fluid downhole and transmit them to the portable unit where software processes them for displaying the fluid level on the screen. Although the portable unit can register the logged data and the processing results, or even transmit them to a distant location, a person is needed on site to handle triggering of the pressurized gas shot.

Conventional equipment requires an operator to be there to activate the pressurized gas source.

U.S. Pat. No. 8,902,704 to Rohol discloses a system for logging the fluid level in an oil borehole by emitting pressure waves which are reflected back up by the fluid and the travel time of the acoustic event is measured. Other acoustic systems are disclosed in U.S. Pat. Nos. 3,965,983, 5,285,388, 5,715,890 and 10,087,743. WO publication 2017/106,218 by Schlumberger discloses to a gun for generating an acoustic wave in a borehole.

U.S. Pat. No. 6,237,410 assigned to Tri Ener suggests controlling the speed of a downhole pump according to the height of the liquid in the borehole. By means of an acoustic pulse the level of the liquid is determined and the reflections associated with joints located at known depths in the borehole are used for determining the acoustic propagation velocity in the borehole.

BRIEF DESCRIPTION OF THE INVENTION

The levels of liquid downhole may impredictably vary during extraction of crude oil or natural gas. It is convenient during these operations that the pump be submerged in a liquid pressure optimizing both its operation as well as the flow pumped upwards. Considering equipment has to be transported to remote locations where well-sites are usually found, times between level measurements tend to be stretched. However, controlling the levels only once a month presumes the risk that the pump could operate inefficiently during an extended length of time, risking ruining the pump and losing production.

In one aspect, the invention teaches a stand-alone apparatus for in situ installation at an oil well. In another aspect, methods for operating the apparatus in a low signal-to-noise ratio environment and for real-time optimization of operational parameters of oil-extraction equipment, in particular downhole extractor pumps, are taught.

An object of the present invention is to obtain a level detector apparatus which can be used in oil or gas production boreholes for determining the level of the fluid downhole, by means of a stand-alone apparatus which does not require the attention of an operator on site, is economical and allows repeating measurements at short time intervals, such as daily, more than once a day or even continually monitor the level. A more particular object is to determine the submergence of a pump used downhole for extraction of oil or gas, eventually regulating the pumping rate.

These and other objects which may become apparent in the course of this description are attained by the invention of a stand-alone level-detector apparatus for boreholes, wherein the acoustic wave emitter and the acoustic wave detector are integrated into one same electroacoustical transducer, of a type similar to a speaker structured with a diaphragm joined to a coil immersed in a magnetic field or of a magnetic piston type, and which is driven by a generator generating electrical pulses having a predetermined waveform. In this way, the compressed-gas source may be dispensed with.

The main advantages of this level-detector apparatus compared to others on the market is its autonomy, its capacity for sending several level measurements daily and that it does not need qualified personnel to manage it nor for ordinary maintenance. The apparatus is installed beside the borehole where it periodically or continually reports the fluid level by telemetry. The well-site operator no longer needs to outsource the job. Not only are operational costs reduced in this way but updated information is made permanently available.

The present invention further involves operational methods for overcoming a problem caused by acoustic noise which is present in the borehole and the low reliability of a measurement obtained with little power on account of the limitations in this sense inherent of a speaker or a magnetic piston for generating a pressure wave of the magnitud obtainable with a conventional gas gun or cannon. The signal-to-noise ratio of a reflected acoustic wave is around one hundred to one thousand times less than in a conventional pressurized gas system to the point that the noise would mask the precision in the determination of the maximum peak in a logged amplitude or intensity curve with one individual individual reflection.

A first solution comprises, for each determination, the steps of:

- emitting a characteristic acoustic signal as a burst in the mouth of the borehole by means of the electroacoustical transducer,
- detecting an acoustic wave containing reflections of the burst returning to the mouth of the borehole,
- logging the curve of variation of the amplitude (intensity) of the detected acoustic wave as a function of time, and
- measuring the time-interval between the emission of the burst and the reflection generated by the level of the fluid by cross-correlating the logged curve of variation of the amplitude with the emitted signal.

The term "characteristic" means that the burst is emitted with some known identification property so that it can be recognised in the detection of the reflection as coming from the emitted burst.

A second solution comprises, for each determination, repeating the steps of emitting, detecting and logging some n times, and thereafter accumulating the n curves logged in the n repetitions, such as adding them (or processing them in some equivalent way such as applying cross-correlation), so as to integrate the curves into a resulting overall curve in order to improve the ratio between the invariant response to the emitted burst and the signal component due to the acoustic noise or any other emission source. The resulting overall curve so obtained is filtered to detect the presence of the emitted burst therein and compute the exact instant when the echo was generated.

Ideally, the present invention provides a method which integrates both solutions for better results.

In this manner, it is possible to determine from the logged curve, performing one or both methods, a time-interval between the emission of the burst and the detection of a reflected acoustic wave. Finally, both methods envisage determining the distance travelled by the acoustic wave reflected in the borehole on the basis of the measured time-interval and the acoustic propagation velocity inside the borehole, for obtaining a precise determination of the fluid level in the borehole.

The propagation velocity of the acoustic wave in the medium inside the borehole can be measured as part of the method by furthermore using the additional reflections forthcoming due to the presence of joints in the string inside of the borehole, the depths of which are known beforehand.

This method may be applied for determining the submergence of the pump inside the liquid based on the difference between the depth of the pump in the borehole and the detected level of the liquid, for eventually regulating the pump speed as convenient.

The references to speakers in the context of the present invention defines a transducer with a diaphragm which is vibrated by a driver device, such as a coil integrated with the diaphragm, which is placed within a magnetic field and is driven by an electrical, preferably subsonic signal.

BRIEF DESCRIPTION OF THE DRAWINGS

The aspects of the invention and the ensuing advantages may be brought out in the following description of a preferred embodiment, with references to the attached figures, in which:

FIG. 1A shows the emission of an acoustic or sub-acoustic wave and how it travels through the borehole down to a fluid level to be detected and FIG. 1B the wave reflected at the interphase between the media present in the borehole and the liquid and how it travels up through the borehole towards the level detector.

Finally.

In all the figures, like reference numerals correspond to like elements of the level detector.

DESCRIPTION OF A PREFERRED EMBODIMENT ILLUSTRATED IN THE DIBUJOS

Figure 1A:
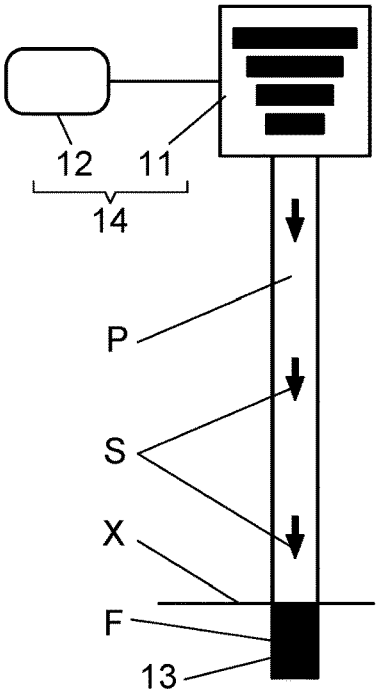
FIGS. 1A and 1B represent simplified schematics of the operation of the level detection according to the present invention through respective schematical cross-sections showing a borehole of a hidrocarbon well-site with a level detector.
Figure 1B:
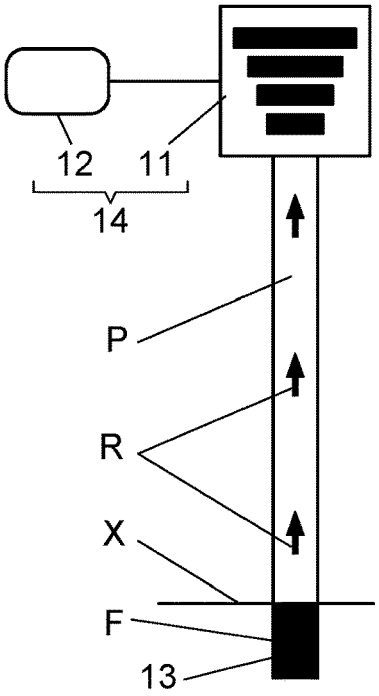

In FIGS. 1A and 1B a speaker 11 functioning as a dual emitter/receiver transducer is connected at the mouth of a borehole P at the bottom of which there is a liquid F the level X of which is to be monitored. In FIG. 1A the speaker 11 has emittted a pulsated incident pressure wave with a predetermined specific waveform (as detailed further on) which travels downwards through the borehole P. The instant of emission of the wave is registered as time zero in a control circuitry 12 connected to the speaker.

In FIG. 1B a small fraction of the emitted wave has been reflected by the interphase at said level X and travels in the opposite direction, with noise coupled from other sources, back to the same speaker 11 where it is detected by the diaphragm thereof. The time lapsed since said zero-instant multiplied by the propagation velocity (which may be measured in the same process) gives (divided by two) the distance from the mouth of the borehole to the level X of the fluid F. FIGS. 1A and 1B schematically show a pump 13 the submergence of which is to be controlled.

Figure 2:
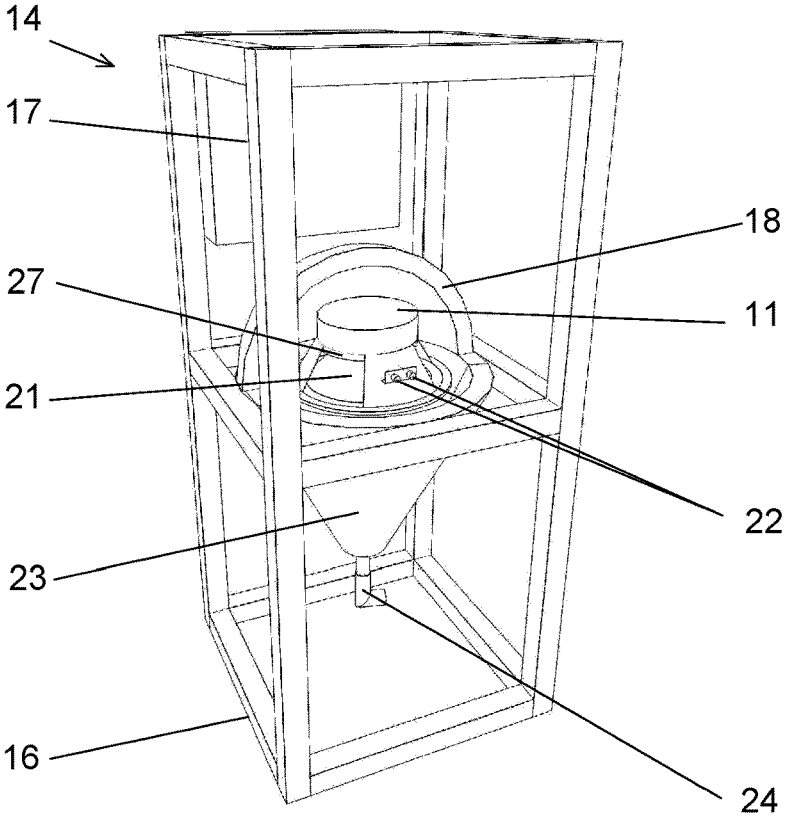
FIG. 2 is a schematical perspective view of a stand-alone apparatus for determining the fluid level in the borehole according to a preferred embodiment of the invention.

FIG. 2 shows the apparatus 14 of the present invention developped as a stand-alone unit. It comprises a frame 16 mounting a housing 17 protecting the electronics inside from climatic elements. Said electronics includes control circuitry for generating and amplifying the pulsating signal generating the pressure wave and a processor with computer software for executing the determinations detailed further on herein.

A closed acoustic box 18 housing the speaker 11 is mounted inside the frame 16. In particular, the diaphragm 21 of the speaker and two terminals 22 for connecting to the electronics inside the housing 17 are depicted.

Figure 3:
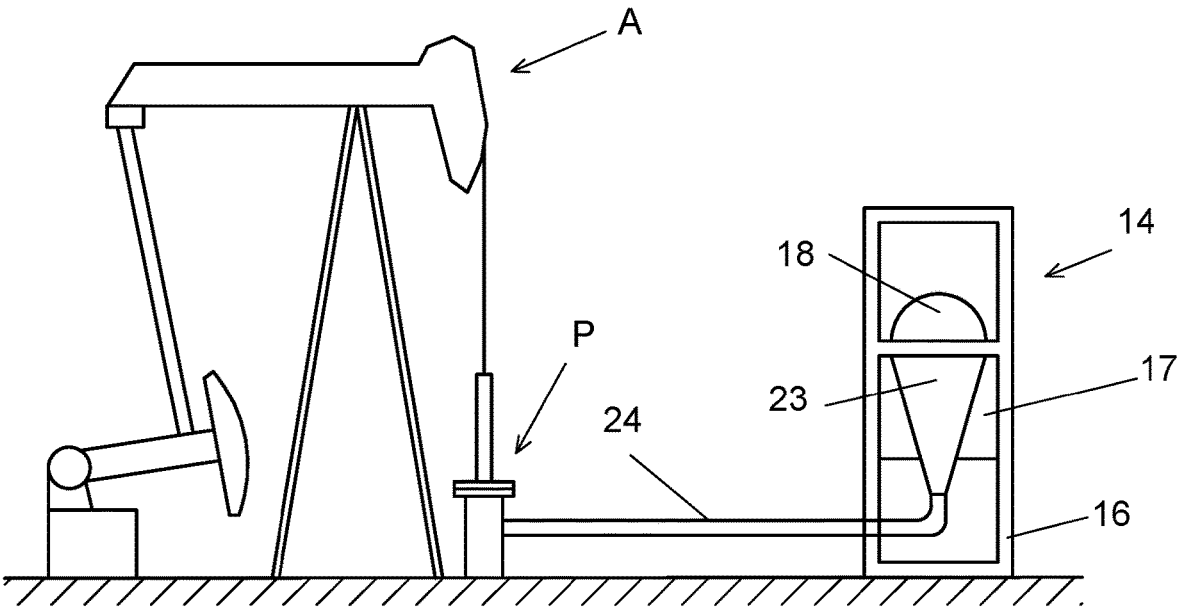
FIG. 3 is a schematical elevation view showing the installation of the detector apparatus of FIG. 2 at the borehole mouth of an oil-well site.

The apparatus 14 of the present invention is installed to one side of the mouth of the borehole P of an AIB A as FIG. 3 shows. The acoustic box 18 has the shape of round dome, inside of which the speaker 11 is affixed, and continues as an inverted-cone 23 which blends into a tube 24 which transmits the pressure wave generated by the speaker 11 into the mouth of the borehole P. The round dome and the inverted-cone duct minimize the generation of internal echo modes and enhance the transmissivity across from the speaker 11 to the mouth of the borehole P.

Figure 4:
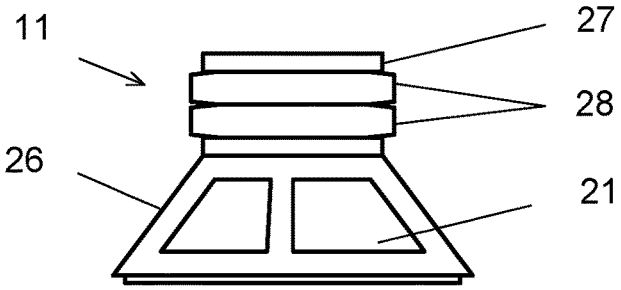
FIG. 4 shows in detail a speaker modified to operate as the dual actuator/detector electroacoustical transducer in the detector apparatus of FIG. 2.

FIG. 4 shows the speaker 11 which has been adapted for this novel function as a dual emitter/receiver or actuator/detector transducer. It comprises a bell 26 with a major diameter measuring 231 mm, a major diameter measuring 135 mm and a height of 93 mm housing the diaphragm 21 which is joined to a coil (not visible) slidingly fitted within polar pieces 27. Two annular ceramic permanent magnets 28 each 147 mm in diameter and 18 mm high magnetize the polar pieces 27 to create a magnetic field across the coil. The coil of the speaker 11 used in this transducer is made with around 140 turns of copper wire 0.45 mm in diameter. In relation to conventional speakers generally used for broadcasting audio, the copper wire of the coil is thicker and the number of turns is less in order to reduce its impedance seen from the electrical side to 2Ω and operate at 300 W. This choice of power may vary according to depth and other physical properties of the boreholes for which the apparatus is destinated.

Figure 5:
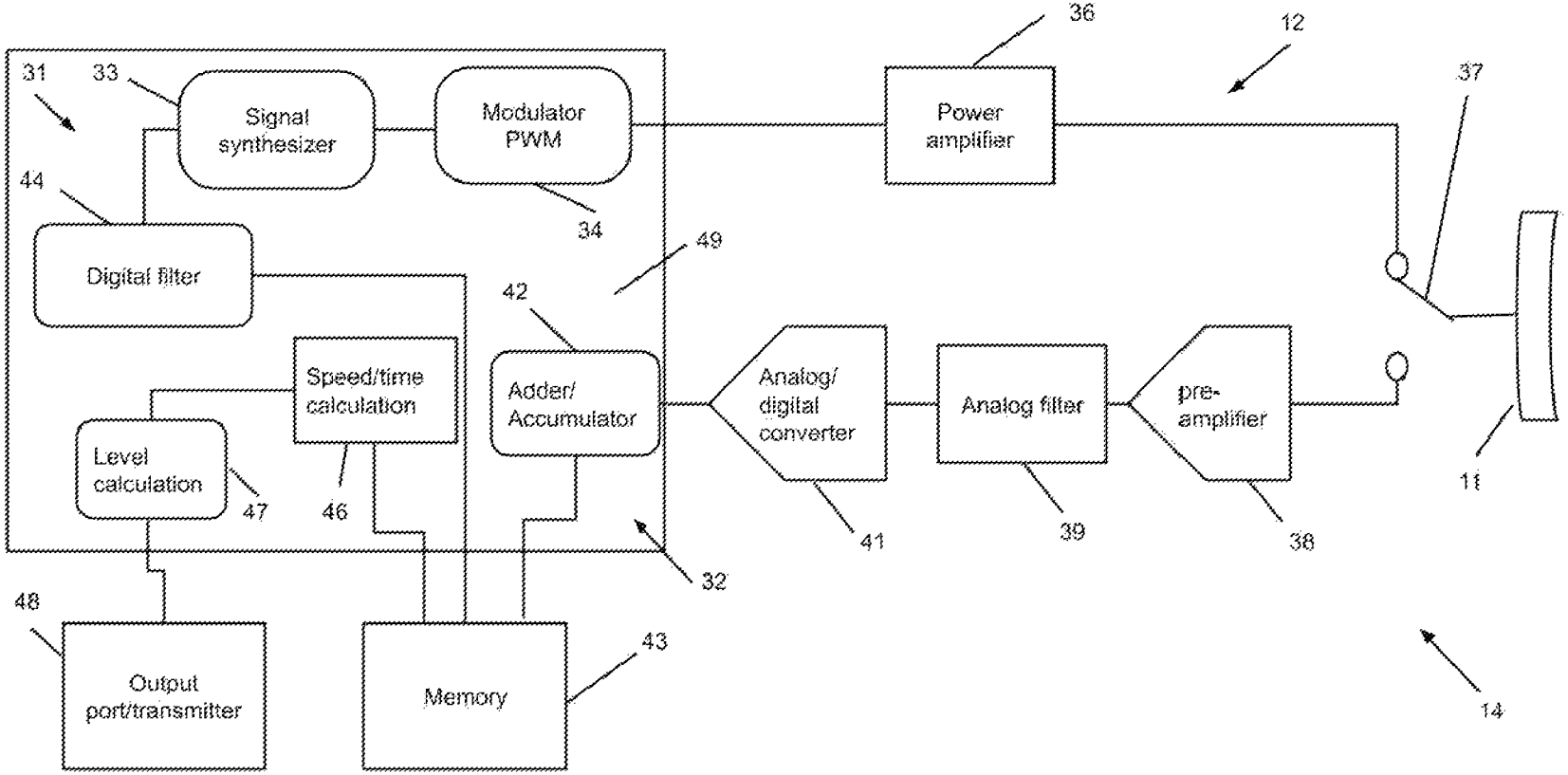
FIG. 5 is a block diagram of the acoustical-signals generation and detection electronics.
Figure 6:
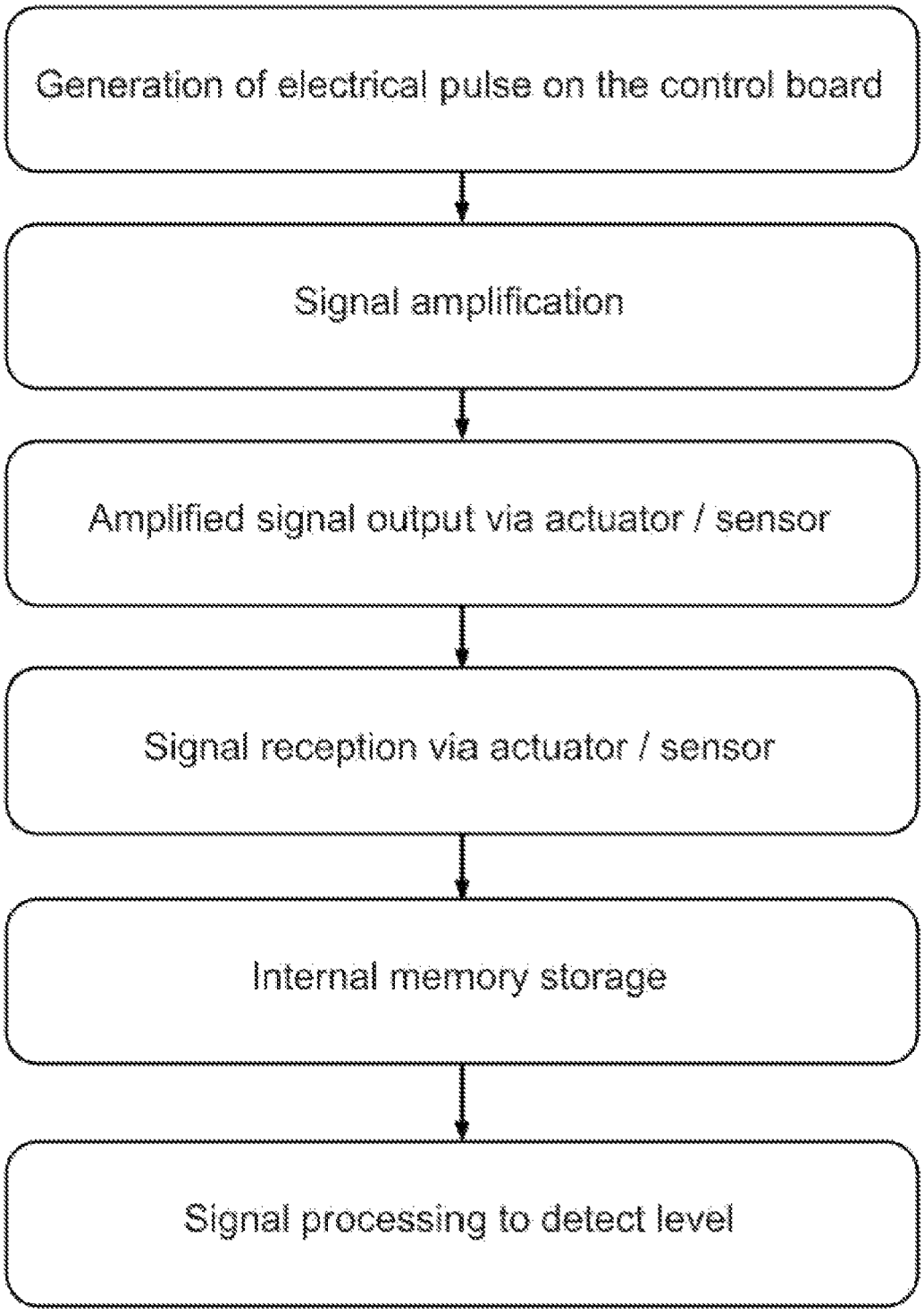
FIG. 6 is a flow-chart illustrating the acoustic-wave level-determining method of the present invention performed with the detector apparatus of FIGS. 2 and 5.
Figure 7:
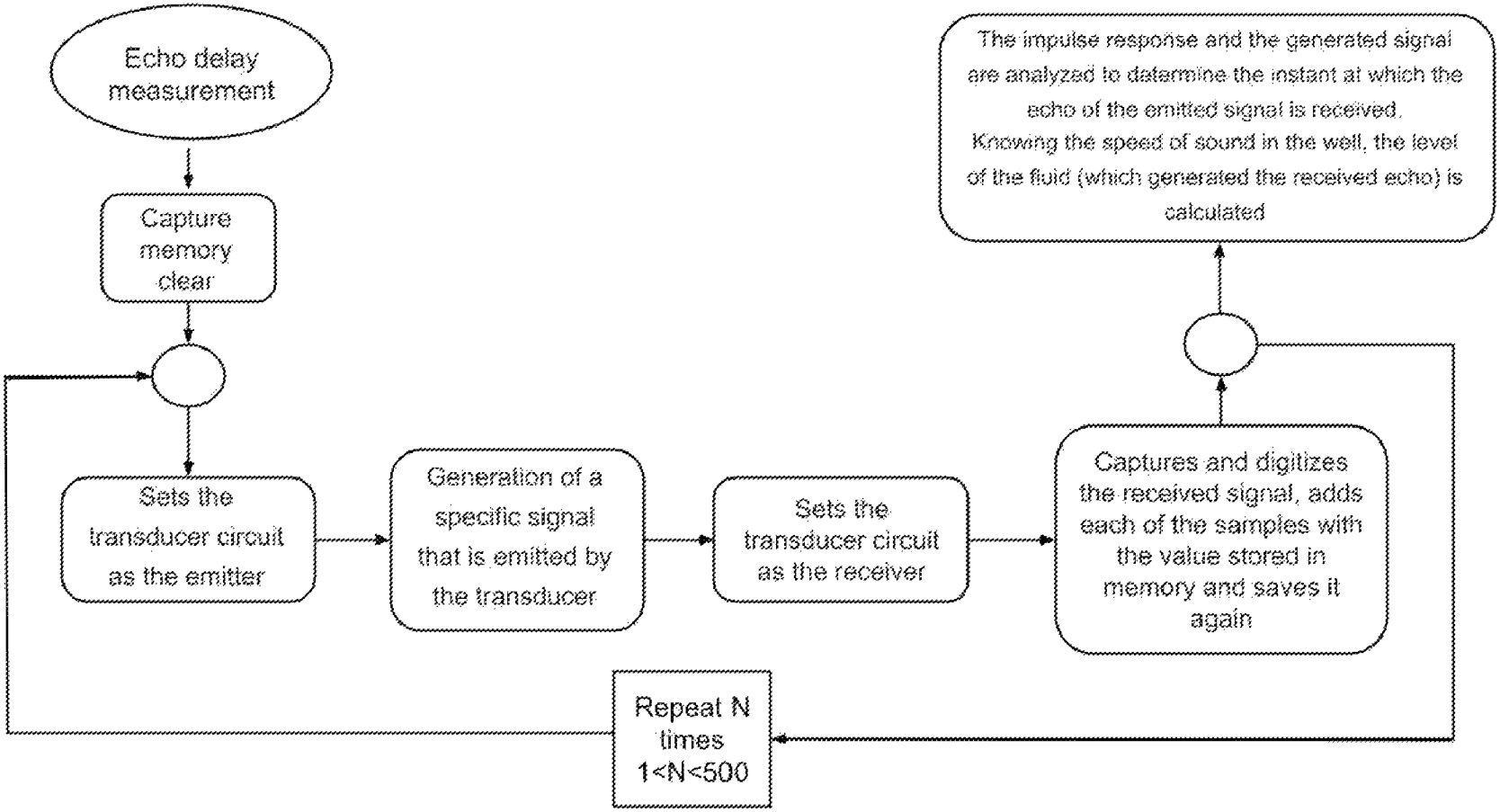
FIG. 7 is a flow-chart of the process for generating, emitting, detecting and processing the acoustical signals for determining the level of the liquid with the detector apparatus of FIGS. 2 and 5.

FIG. 5 shows the control circuitry 12 with the burst generator module 31 and the signal processor module 32. FIG. 6 is a flow chart teaching the essential steps followed by the method in the level detector apparatus and FIG. 7 is a flow chart of the functions implemented in the generator 31 and the processor 32 of FIG. 5. The burst generator 31 comprises a synthesiser 33 which generates a number sequence defining a characteristic property in the form of a pattern or a code in order to be able to later identify and recognise the source of the reflection on the level of liquid as originating from the emitted pulse. This numeric signal controls a pulse-width modulator (PWM) 34 for converting the digital signal into a burst of voltage pulses each of a width encoding said characteristic property (for later identification and recognition by the processor 32), forming an analog signal which is amplified by a power amplifier 36 having an outlet connected by a two-way commuter switch 37 to the loudspeaker 11.

In the position of the switch 37 illustrated in FIG. 5, the speaker 11 functions in an actuator mode converting the electric wave into a mechanical wave pulsating at 5 Hz. The electrical signal supplied by the amplifier 36 causes the diaphragm 21 to vibrate, thereby generating the pressure wave which descends down the inverted-cone duct 23 and enters the tubing 24 from where it travels down the borehole P. Minor reflections occur at joints of the string and a major reflection at the fluid level X. All these reflections return back up to the diaphragm 21.

Figure 8A:
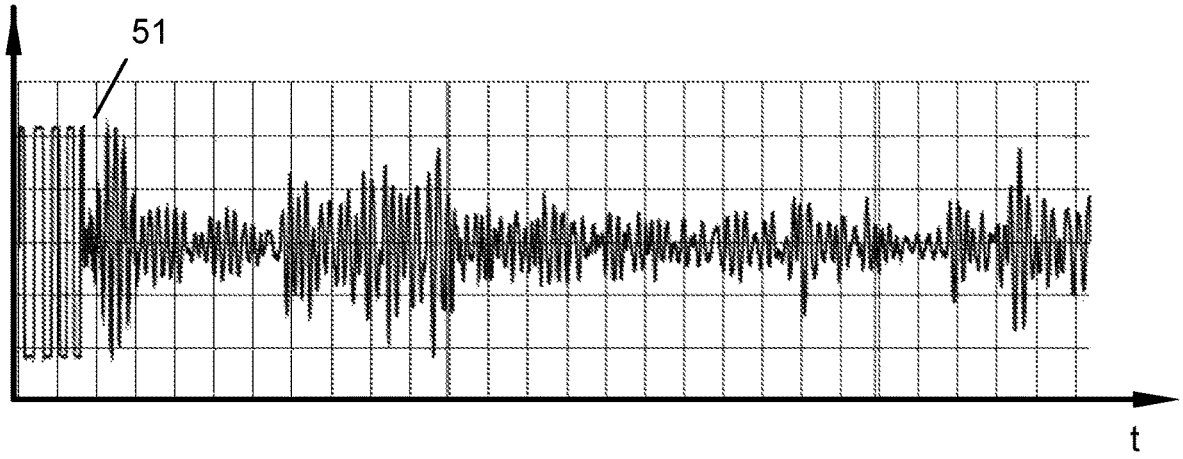
FIGS. 8A, 8B and 8C graph curves of signal amplitude (vertical axis) as a function of time (horizontal axis) corresponding to three different acquisition cycles of a single determination.

By then, after about 5 seconds, for example, the control circuitry 31 has flipped the switch 37 to engage the signal processor 32, inverting the function of the speaker 11 to now act as a sensor for detecting pressure variation. The vibrating diapragm causes the attached magnet to induce an electrical signal in the coil of the speaker 11 having a representative voltage amplitude that the flipped switch 37 passes on to a preamplifier 38 which amplifies the input signal and on to an analog band-pass filter 39 tuned to discriminate some frequency components that do not form part of the original signal. FIG. 7 details the processing of the sensed signal. The preamplified and filtered signal is supplied to an analog-to-digital converter 41 which uses the voltage variations thereof to generate a number sequence which is stored in a memory 43. FIG. 8A is a graph of the curve of a first stored signal, explained further on hereinbelow.

This cycle of emitting a burst, detecting reflection, processing a detected signal and obtaining the fluid-level result is repeated n times, where $1<n<500$, preferably $10<n<200$ or $10<n<100$. The second cycle is carried out time-wise close to the first, conveniently a few seconds after, and so on with the third and subsequent cycles, to avoid corrupting data should the borehole conditions undergo changes.

The PWM modulator 34 is additionally controlled to form the analog signal with a frequency that changes in each repetition of the burst emission, for example beginning at 5 Hz and progresively increasing in 1 Hz-steps at a time up to 20 Hz, for example. Changing the frequency in each repetition improves immunity against eventual gaps in the borehole frequency response caused by points of resonance or local acoustic absortion.

In the processor 32, an adder/accumulator 42 integrates every inputted number sequence with the sequences previously stored in a memory 43. A digital filter 44 carries out a discrete cross-correlation between the number sequence generated by the synthesiser and the sequence stored in a memory which is the result of the previous additions. The cross-correlation result is a new number sequence which is stored in the memory and with which the time the echo is delayed in the borehole is calculated and the fluid level in the borehole is computed in respective calculator units 46 and 47. This information can be transmitted in real-time via a transmitter port 48 or in a telemetric system remotely polled or a connection in situ for regulating the speed of the pump downhole.

Figure 8B:
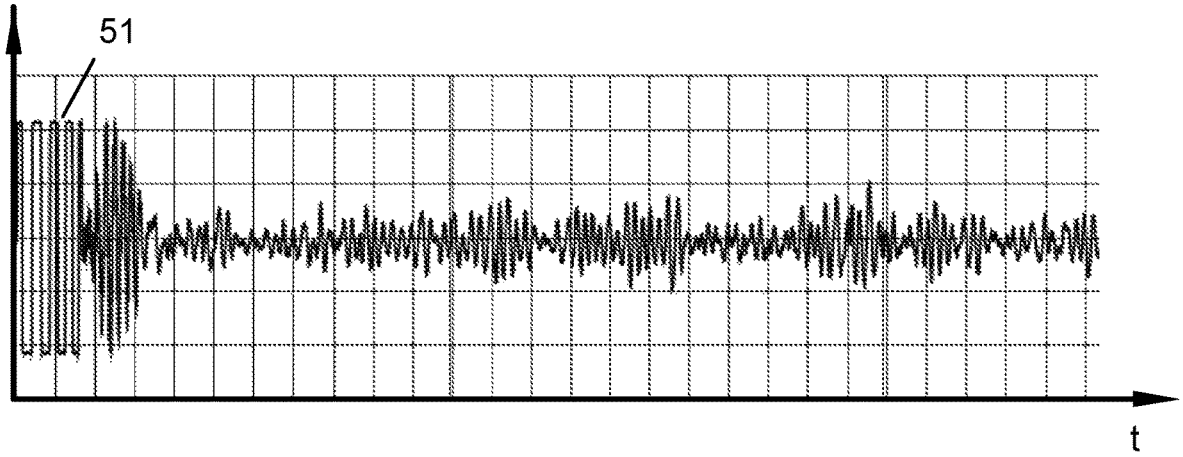
Figure 8C:
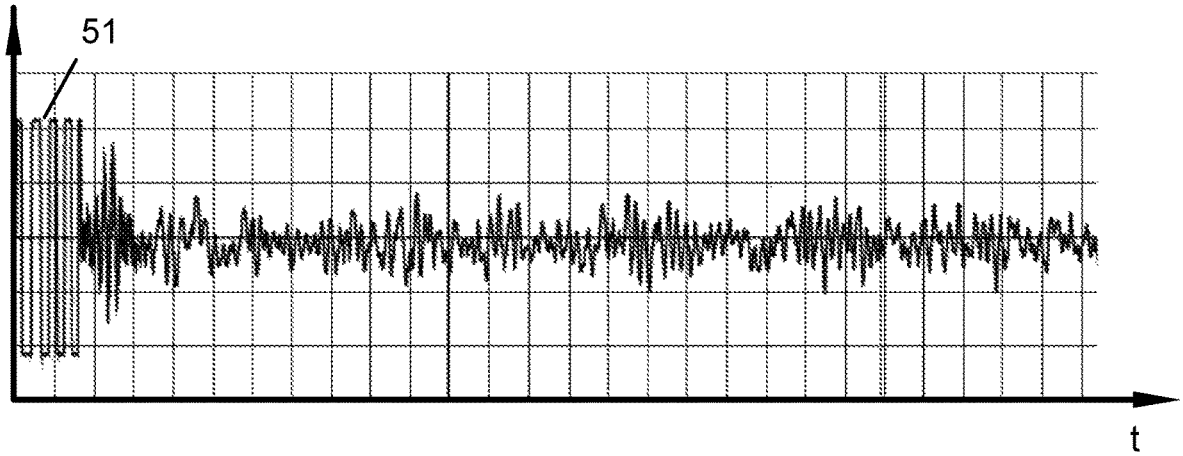

In FIGS. 8A, 8B and 8C graphs of three of the n individual curves that were obtained consecutively and then summed or integrated are shown together with the signal 51 that generates the pulses transmitted by the transducer 11. The weak response that is detected is masked by the acoustic noise from the borehole P making it impossible to distinguish a recognisable peak as coming from an echo bounced back by the surface X of the liquid F.

Figure 8D:
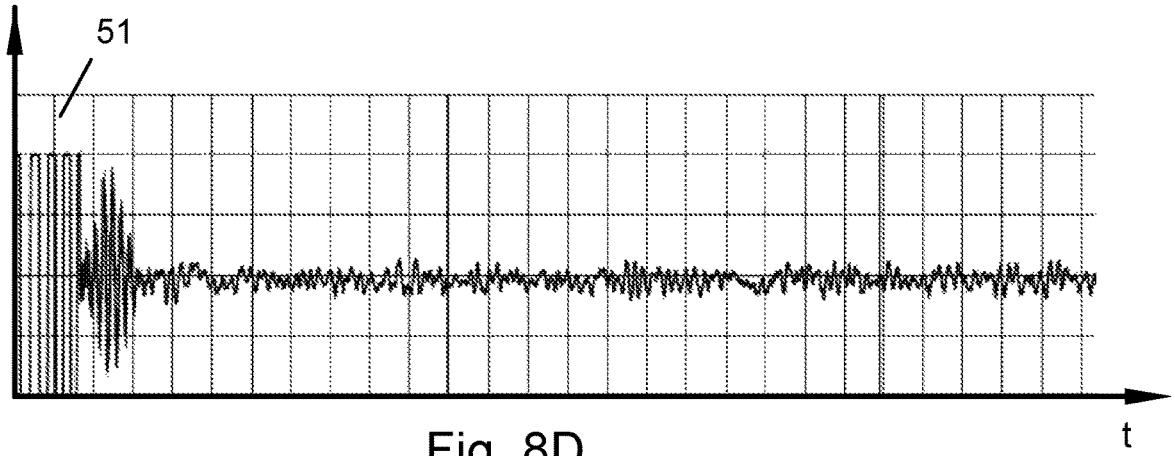
FIGS. 8D and 8E show curves obtained by summing and averaging (accumulating) n=100 and n=150 consecutive curves as those of FIGS. 8A, 8B and 8C.
Figure 8E:
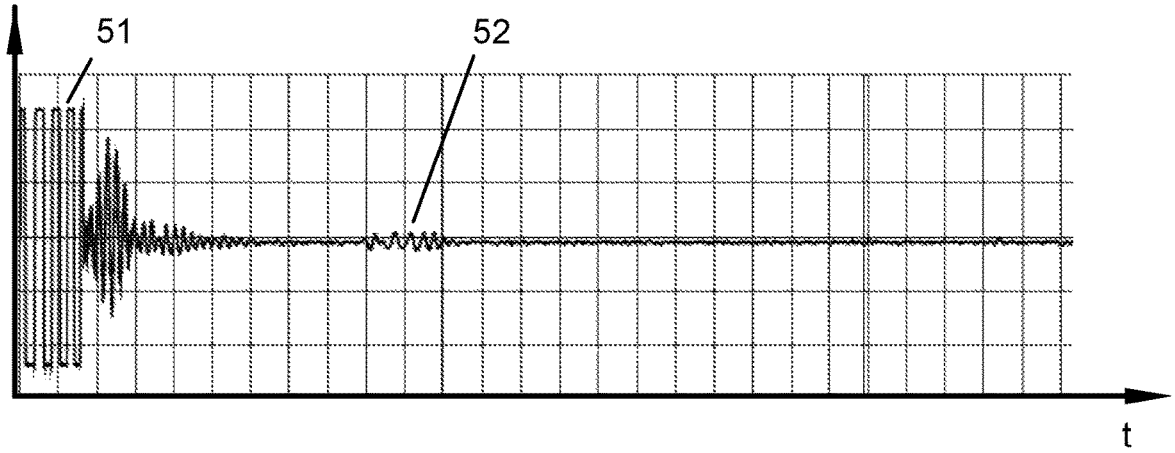

FIG. 8D shows the curve resulting from adding and averaging n=100 curves of the same determination analogous to those of FIGS. 8A, 8B and 8C but without correlation with the emission signal 51, wherein a recognisable echo is still un-distinguishable. FIG. 8E is analogous to FIG. 8D for a greater number n=150 of repetitions where the echo 52 is barely distinguishable although without the reliability required by the circumstances.

Figure 8F:
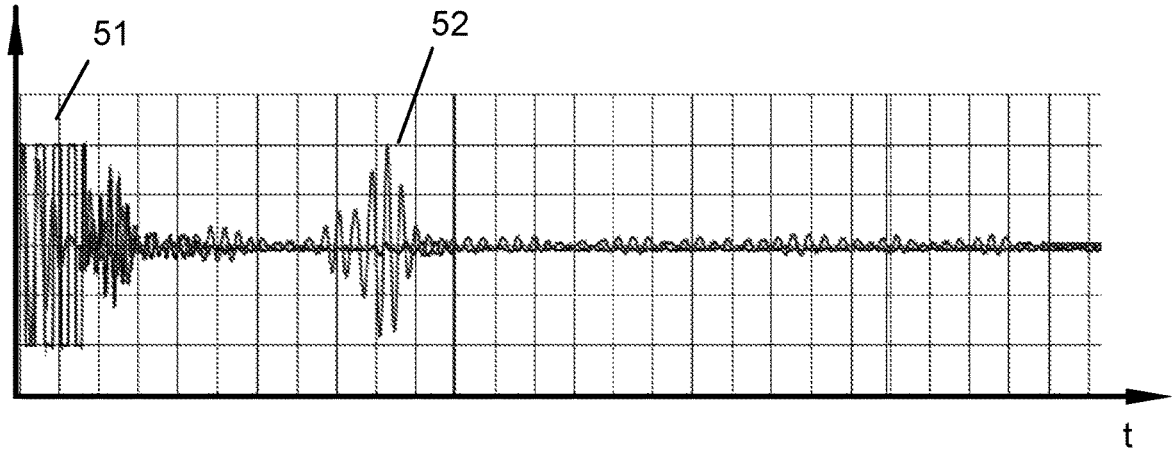
FIG. 8F shows the curve resulting from the determination after the curves are correlated.

FIG. 8F shows the curve resulting from correlating the n=150 curves with the emission signal 51 such that the echo 52' is easily distinguishable.

The digital part of the signal generator 31 and processors 32 modules are conveniently integrated into a central processing unit or controller 49.

The number of n repetitions which are necessary depends on the level of acoustic noise in each borehole in particular and may be empirically determined; it could be a relatively low number in relatively silent boreholes and high in noisy boreholes. To empirically determine a value for n, a low value is initially estimated and the result is evaluated comparing the peak having the highest amplitude corresponding to the reflection on the surface of the liquid with the nearest peaks. If the peak having the highest amplitude at least doubles the nearest peaks, n may be deemed sufficient; otherwise n is increased until it is.

Figure 9:
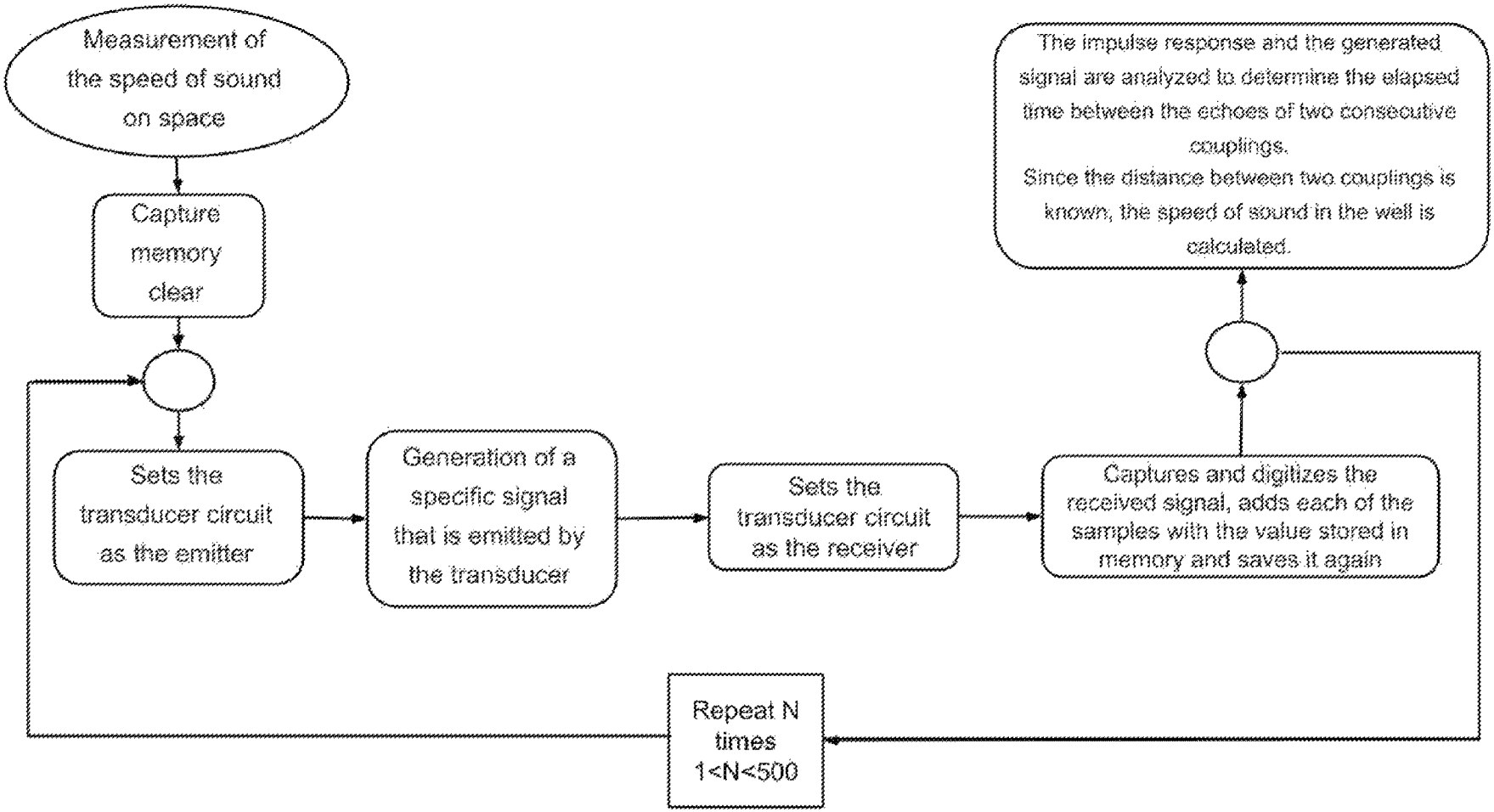
FIG. 9 is a flow-chart of the method for processing the detected acoustical signals for determining the propagation velocity of pressure waves in the borehole tubing.

A flow-chart is represented in FIG. 9 with the functions implemented to determine the speed of sound in the borehole. The fluid level in the borehole may be determined with this data. Both measurements should be carried out in a determined time-interval to be sure that the conditions remain stable between measurements.

In order to determine the delay time of the echo, a signal is generated with a configurable frequency that varies between 5 and 20 Hz, during 1 to 6 seconds. To determine the speed of sound, a signal is generated with a configurable frequency that varies between 20 and 400 Hz, during 10 to 50 milliseconds. In the first case, the minimum sampling is 200 samples per second. In the second case, the minimum sampling is 5,000 samples per second. The switch to a higher frequency for determining the propagation velocity is due to the convenience of using a shorter wavelength in order to enhance reflections on the string joints over reflections on the surface of the liquid.

The cycles for determining the acoustic velocity in the borehole may be carried out a short time before or after determining the fluid level or else alternate cycles of determination procedures. Moreover, it would be possible to simultaneously use the same response curve for the delay and the velocity processes, processing two echos separately (respectively returned by the liquid level and by a joint).

A particular embodiment of the level detector has been disclosed hereinabove although changes insofar materials, shapes, sizes, geometry and components of the level detector may be carried out without departing from the scope of the present invention as defined in the following claims. By way of example, the same speaker is used both as the emitter device and as the detector device although it is evident that the measurements may be performed using separate electroacoustical transducers. The speaker need not necessarily be a loudspeaker in the audiofrequency range although it may be preferred, such as for cost reasons, to adapt a similar type for operating at a low frequency, in particular under the human auditive range. The references to curves are not exclusively limited to graphic representations but include variable mathematical functions.

We claim:

1. A level detector for determining the level of a liquid in a borehole and which includes:

a signal generator for generating a first signal including a recognizable characteristic, an acoustical emitter for emitting said first signal as an acoustical wave towards the liquid in the borehole, an acoustical wave detector for receiving a return acoustic wave containing a reflection from the liquid of the emitted acoustic signal and a detected wave processor for receiving said first signal generated by the signal generator and a second signal from said detector representative of said return acoustic wave and adapted for measuring intervals of time lapsed between emitted waves and detected waves and determining said level based on the measured time-interval;

wherein the acoustical wave emitter and the acoustical wave detector are integrated in a same electroacoustical transducer;

wherein the electroacoustical transducer is housed inside a closed acoustic box in acoustic communication with a borehole mouth and said electroacoustical transducer is electrically connected to the signal generator and to the processor, the generator comprising a synthesiser for generating a first number sequence which controls a voltage pulse modulator for forming an analog signal which is supplied to the electroacoustical transducer via a power amplifier, whereas the processor comprises a preamplifier for incrementing the reflection signal coming from the electroacoustical transducer in a sensor mode, an analog-to-digital converter for generating at least one second number sequence from the filtered signal and a digital filter adapted to discretely cross-correlate the first number sequence generated by the synthesiser and the second number sequence for providing a third number sequence for calculating the time-interval lapsed between the supply of the analog signal to the electroacoustical transducer and the reception on the part of the same electroacoustical transducer of a reflection of the emitted acoustical wave.

2. The level detector of claim 1, wherein the electroacoustical transducer is a high-power and low-impedance loudpeaker.

3. The level detector of claim 1, wherein the electroacoustical transducer is a 300W-power and 2Ω-impedance loudpeaker.

4. The level detector of claim 1 for determining the liquid level in the borehole or the acoustic propagation velocity inside the borehole and further comprising an accumulator for adding up or otherwise integrating the generated second number sequences and a memory for storing these generated second number sequences, wherein the digital filter is arranged for carrying out the discrete cross-correlation between the first number sequence generated by the synthesiser and the sum of the second number sequences stored in the memory to provide the third number sequence for calculating said time-interval.

5. A method for determining the level of a liquid in a borehole and which includes the steps of:

(a) emitting an acoustic signal towards the liquid in the borehole, (b) detecting an acoustic wave containing a reflection from the liquid of the acoustic signal emitted in step (a), (c) logging the curve of variation of the amplitude of the detected acoustic wave as a function of time, and (d) determining the distance travelled by the acoustic wave reflected from the borehole based on the time-interval logged between the emission of the pulse and the detection of a maximum in the amplitude of the reflected acoustic wave, and the acoustic propagation velocity inside the borehole;

(e) repeating the steps (a), (b) and (c) at least n times, (f) accumulating the n curves logged in the repetitions of steps (c), (g) measuring the time-interval from the emission of the pulse to a maximum in the amplitude of the accumulated curve, and (h) carry out step (d) on the basis of this latter time-interval;

wherein step (a) comprises emitting the acoustic signal in the form of a burst, n is greater than 10 and the step (f) of accumulating the n logged curves comprises adding them.

6. The level determining method of claim 5, wherein step (d) further includes cross-correlating the curve resulting from accumulating the n curves logged in step (f) with the signal generating the pulse emitted in step (a).

7. The level determining method of claim 5, wherein step (a) is carried out with a pulse having a power of 300 W.

8. The level determining method of claim 5, wherein step (a) comprises synthetizing a number sequence for codifying the emitted signal and converting it into an analog signal having a frequency, and step (b) includes recognising said codifying number sequence in the detected reflection as a content of the emitted signal.

9. The level determining method of claim 5, further including measuring at least a second time-interval corresponding to the detection of a minor maximum in the amplitude curve corresponding to a reflection of the wave on a physical singularity in the borehole the depth of which is known, determining the velocity of propagation of the acoustic wave in the borehole and using the propagation velocity so determined as a factor in the determination of the level of the liquid.

10. The level determining method of claim 9, wherein the step (a) includes emitting respective acoustical signals at different instants for detecting in step (b) said liquid-reflected wave for determining said liquid level and said reflection of the wave in said physical singularity at a known depth in the borehole for determining said propagation velocity, wherein said signal for determining the propagation velocity is emitted at a frequency substantially higher than that of said pulse for determining the liquid level.

11. A method for determining the level of a liquid in a borehole and which includes the steps of:

(a) emitting an acoustic signal towards the liquid in the borehole, (b) detecting an acoustic wave containing a reflection from the liquid of the acoustic signal emitted in step (a), (c) logging the curve of variation of the amplitude of the detected acoustic wave as a function of time, (d) locating in said curve an amplitude maximum of the acoustic wave corresponding to the reflection in the liquid of the emitted acoustic signal, (e) measuring the time-interval between the emission of the acoustic signal and the amplitude maximum of the logged acoustic wave, and (f) determining the distance travelled by the acoustic wave reflected from the borehole based on the measured time-interval and the acoustic propagation velocity inside the borehole;

wherein step (d) includes filtering the amplitude maximum by cross-correlating the curve logged in step (c) with a signal generating the acoustic signal emitted in step (a);

wherein step (a) comprises synthetizing a number sequence for codifying the emitted signal and converting it into an analog signal having a frequency, and step (b) includes recognising said codifying number sequence in the detected reflection as a content of the emitted signal.

12. The level determining method of claim 11, further comprising:

(g) repeating the steps (a), (b) and (c) at least n times wherein n is greater than 10, (h) accumulating the n curves logged in the repeated steps (c), (i) measuring in step (e) the time-interval from the emission of the pulse to a maximum in the amplitude of the accumulated curve, and (j) carry out step (f) with this latter time-interval of step (i).

13. The level determining method of claim 11, wherein step (a) comprises emitting the acoustic signal in the form of a burst or a pulse having a power of 300 W.

14. The level determining method of claim 11, further including measuring at least a second time-interval corresponding to the detection of a minor maximum in the amplitude curve corresponding to a reflection of the wave on a physical singularity in the borehole the depth of which is known, determining the velocity of propagation of the acoustic wave in the borehole and using the propagation velocity so determined as a factor in the determination of the level of the liquid.

15. The level determining method of claim 14, wherein the step (a) includes emitting respective acoustical signals at different times for detecting in step (b) said liquid-reflected wave for determining the level and said reflection of the wave in said physical singularity at a known depth in the borehole for determining said propagation velocity, wherein said signal for determining the propagation velocity is emitted at a frequency substantially higher than that of said pulse for determining the liquid level.

16. A method for controlling the operation of a pump submerged in a liquid in a borehole and the performance of which is a function of the pressure of said liquid, comprising the steps of: determining the level of the liquid in the borehole by the method of claim 5, determining the submergence of the pump based on the difference between the depth of the pump in the borehole and said level of the liquid, adjust a pumping parameter according to the determined submergence; wherein the step of adjusting the pumping parameter preferably comprises adjusting the speed of the pump on the basis of a preset index relative to the pressure of the liquid.

17. A method for controlling the operation of a pump submerged in a liquid in a borehole and the performance of which is a function of the pressure of said liquid, comprising the steps of: determining the level of the liquid in the borehole by the method of claim 11, determining the submergence of the pump based on the difference between the depth of the pump in the borehole and said level of the liquid, adjust a pumping parameter according to the determined submergence; wherein the step of adjusting the pumping parameter comprises adjusting the speed of the pump on the basis of a preset index relative to the pressure of the liquid.

18. A method for determining the level of a liquid in a borehole and which includes the steps of:

(a) emitting an acoustic signal towards the liquid in the borehole, (b) detecting an acoustic wave containing a reflection from the liquid of the acoustic signal emitted in step (a), (c) logging the curve of variation of the amplitude of the detected acoustic wave as a function of time, (d) locating in said curve an amplitude maximum of the acoustic wave relevada corresponding to the reflection in the liquid of the emitted acoustic signal, (e) measuring the time-interval between the emission of the acoustic signal and the amplitude maximum of the logged acoustic wave, and (f) determining the distance travelled by the acoustic wave reflected from the borehole based on the measured time-interval and the acoustic propagation velocity inside the borehole;

wherein step (d) includes filtering the amplitude maximum by cross-correlating the curve logged in step (c) with a signal generating the acoustic signal emitted in step (a);

further including measuring at least a second time-interval corresponding to the detection of a minor maximum in the amplitude curve corresponding to a reflection of the wave on a physical singularity in the borehole the depth of which is known, determining the velocity of propagation of the acoustic wave in the borehole and using the propagation velocity so determined as a factor in the determination of the level of the liquid.

19. The level determining method of claim 18, wherein the step (a) includes emitting respective acoustical signals at different times for detecting in step (b) said liquid-reflected wave for determining the level and said reflection of the wave in said physical singularity at a known depth in the borehole for determining said propagation velocity, wherein said signal for determining the propagation velocity is emitted at a frequency substantially higher than that of said pulse for determining the liquid level.

20. A method for determining the level of a liquid in a borehole and which includes the steps of:

(a) emitting an acoustic signal towards the liquid in the borehole, (b) detecting an acoustic wave containing a reflection from the liquid of the acoustic signal emitted in step (a), (c) logging the curve of variation of the amplitude of the detected acoustic wave as a function of time, and (d) determining the distance travelled by the acoustic wave reflected from the borehole based on the time-interval logged between the emission of the pulse and the detection of a maximum in the amplitude of the reflected acoustic wave, and the acoustic propagation velocity inside the borehole;

(e) repeating the steps (a), (b) and (c) at least n times, (f) accumulating the n curves logged in the repetitions of steps (c), (g) measuring the time-interval from the emission of the pulse to a maximum in the amplitude of the accumulated curve, and (h) carry out step (d) on the basis of this latter time-interval;

wherein step (a) comprises synthetizing a number sequence for codifying the emitted signal and converting it into an analog signal having a frequency, and step (b) includes recognising said codifying number sequence in the detected reflection as a content of the emitted signal.

21. A method for determining the level of a liquid in a borehole and which includes the steps of:

(a) emitting an acoustic signal towards the liquid in the borehole, (b) detecting an acoustic wave containing a reflection from the liquid of the acoustic signal emitted in step (a), (c) logging the curve of variation of the amplitude of the detected acoustic wave as a function of time, and (d) determining the distance travelled by the acoustic wave reflected from the borehole based on the time-interval logged between the emission of the pulse and the detection of a maximum in the amplitude of the reflected acoustic wave, and the acoustic propagation velocity inside the borehole;

(e) repeating the steps (a), (b) and (c) at least n times, (f) accumulating the n curves logged in the repetitions of steps (c), (g) measuring the time-interval from the emission of the pulse to a maximum in the amplitude of the accumulated curve, and (h) carry out step (d) on the basis of this latter time-interval;

further including measuring at least a second time-interval corresponding to the detection of a minor maximum in the amplitude curve corresponding to a reflection of the wave on a physical singularity in the borehole the depth of which is known, determining the velocity of propagation of the acoustic wave in the borehole and using the propagation velocity so determined as a factor in the determination of the level of the liquid.

22. The level determining method of claim 21, wherein the step (a) includes emitting respective acoustical signals at different instants for detecting in step (b) said liquid-reflected wave for determining said liquid level and said reflection of the wave in said physical singularity at a known depth in the borehole for determining said propagation velocity, wherein said signal for determining the propagation velocity is emitted at a frequency substantially higher than that of said pulse for determining the liquid level.

* * * * *